US005167246A

United States Patent [19]

Mortenson

[11] Patent Number: 5,167,246

[45] Date of Patent: Dec. 1, 1992

[54] RAPIDLY ERECTABLE AND STRIKEABLE SHELTER FRAME SYSTEM AND METHODS OF ERECTING AND STRIKING SUCH SYSTEMS

[75] Inventor: Carl N. Mortenson, Midland, Mich.

[73] Assignee: Magline, Inc., Pinconning, Mich.

[21] Appl. No.: 526,035

[22] Filed: May 21, 1990

[51] Int. Cl.[5] ..... E04H 15/44

[52] U.S. Cl. ..... 135/106; 135/109; 403/92; 403/97

[58] Field of Search ..... 135/106, 107, 109, 101, 135/102, 112; 403/97, 91, 92, 84

[56] References Cited

U.S. PATENT DOCUMENTS

| | | | |
|---|---|---|---|
| 1,204,329 | 11/1916 | Wilkins | 135/109 X |
| 1,509,881 | 9/1924 | Severin | 135/109 |
| 2,151,908 | 3/1939 | Gottlieb | 135/98 X |
| 3,889,908 | 6/1975 | Larson | 248/515 |
| 4,066,089 | 1/1978 | Rainwater | 135/109 X |
| 4,077,418 | 3/1978 | Cohen | 135/109 X |
| 4,974,621 | 12/1990 | Lerma | 135/106 |

FOREIGN PATENT DOCUMENTS

| | | | |
|---|---|---|---|
| 2658838 | 7/1978 | Fed. Rep. of Germany | 403/97 |
| 0217140 | 1/1985 | German Democratic Rep. | 135/105 |

*Primary Examiner*—David A. Scherbel
*Assistant Examiner*—Lan Mai
*Attorney, Agent, or Firm*—Learman & McCulloch

[57] ABSTRACT

A rapidly erectable four cornered shelter frame for use with a canvas top has a pair of foldable end frame members with corner posts and an end joint at the upper end of each having a pair of upwardly inclined end rafters connected by an end ridge joint which has a ridge member projecting perpendicularly to the rafters. A foldable intermediate frame member has ground support posts with side joints at the upper ends having a pair of upwardly inclined intermediate rafters connected by an intermediate ridge joint to which each of the end frame members also connects. Eave members extend from each side joint to releasably connect to each end joint, which also incorporates mechanism to lock the end rafters in extended position, while permitting them to fold down to a position in parallelism with the corner posts when unlocked. The end ridge joints incorporate mechanism to lock the ridge members in extended position, while permitting them to fold down to a position in parallelism with the corner posts when unlocked, and side joints incorporate mechanism to lock the intermediate rafters in extended position, while permitting them to fold down to a position in parallelism with the intermediate ground support posts when unlocked.

18 Claims, 7 Drawing Sheets

RAPIDLY ERECTABLE AND STRIKEABLE SHELTER FRAME SYSTEM AND METHODS OF ERECTING AND STRIKING SUCH SYSTEMS

This invention relates to a lightweight shelter frame capable of being rapidly erected and demounted in adverse conditions and more particularly, to a folding shelter frame system of rectilinear configuration, having four corners capable of supporting a canvas top and sides, or the like.

BACKGROUND OF THE INVENTION

Shelter frame systems of this general character are known and have been produced for both military and civilian use previously. Those known to have been previously produced have incorporated relatively foldable component parts in a tri-arch system which remained unitized in both the erected and folded positions. Considerable instruction and training has been required with such previous designs to erect the rigid tent frame, and to strike it, and the unitary system is considered bulky, too heavy, and too difficult to handle.

SUMMARY OF THE INVENTION

The present invention is directed to an improved, nonwelded, light-weight frame system which has essentially identical, separable, foldable end frames, consisting of vertical legs forming ground support corner posts at two corners of the structure, a pair of upwardly inclined rafters pivotally connected to the corner posts at end frame corner cluster joints, and a ridge member, pivotally connected to the rafters at an end frame ridge cluster joint and extending perpendicularly to the rafters to releasably connect with a separable, foldable, intermediate frame having a pair of transversely spaced vertical legs, forming intermediate ground support posts. The intermediate frame also includes a pair of upwardly inclined rafters, pivotally connected to the intermediate posts at intermediate frame end cluster joints, and an intermediate ridge cluster joint to which each of the rafters pivotally connects, and to which each of the end frame ridge members releasably connects. The intermediate frame has upper side or eave members extending to disengageably connect to the end frame cluster joints. Each of the end frames and intermediate frames is lockable in a rigid inter-assembled position, but can be readily unlocked to permit each of the end frames and the intermediate frame to be folded into a separate compact lightweight bundle which can be readily transported without the danger of losing or misplacing individual components. The various foldable parts of the end frames and intermediate frames are pre-positionable by integral, cam-lockable, cluster joint connections which can be manipulated during erection to rigidize and hold the components in unfolded position for spatial positioning of the elements to facilitate their assembly. To my knowledge, frame systems utilizing such separable foldable subsystems have not previously been employed, nor have such joints and such cam locking, integral connections been so incorporated in such systems.

One of the prime objects of the present invention is to provide a shelter frame of a type which can be made of tubular aluminum and other light weight material, and which lends itself to ready transport and handling of the component parts, when folded, and during the erection and the striking process.

Another object of the invention is to provide a tent shelter frame or the like, which can be manufactured more economically than known designs, and yet has the strength and rigidity necessary to accomplishing its functions.

Still another object of the invention is to provide a shelter frame of simplified design, which is so constructed as to greatly reduce the time required to erect or strike it.

Still a further object of the invention is to provide a shelter frame having simplified, integrated, lockable, mechanical cluster joint assemblies which are easy to manipulate and which do not require undue amounts of training time or instruction because the lockable joint structure rigidizes the unfolded structure during the erection procedure to facilitate positioning, and assembly, of the various parts of the ends frames and intermediate frames, and their inter-assembly to form a unitary structure.

Still another object of the invention is to provide a shelter frame system which includes what may be termed cluster joints functioning to connect the rafters, ridge members, and eave members.

Still another object of the invention is to provide a shelter frame having rugged connections which can absorb the impact of a free fall from the transporting truck bed to the ground, for instance.

A further object of the invention still is to provide a structure which minimizes the requirement for an undue number of reinforcing cables which can easily tangle during erection and disassembly.

A further object of the invention is to provide a rigid shelter frame system for both military and civilian use which can stand hard treatment, and which can be easily set up and dismounted, night or day, in freezing temperatures, which may reach 30° to 40° below zero, for instance, in far northern climes.

Other objects and advantages of the invention will be pointed out specifically, or will become apparent from the following description, when it is considered in conjunction with the appended claims and the accompanying drawings.

GENERAL DESCRIPTION

Figure 1:
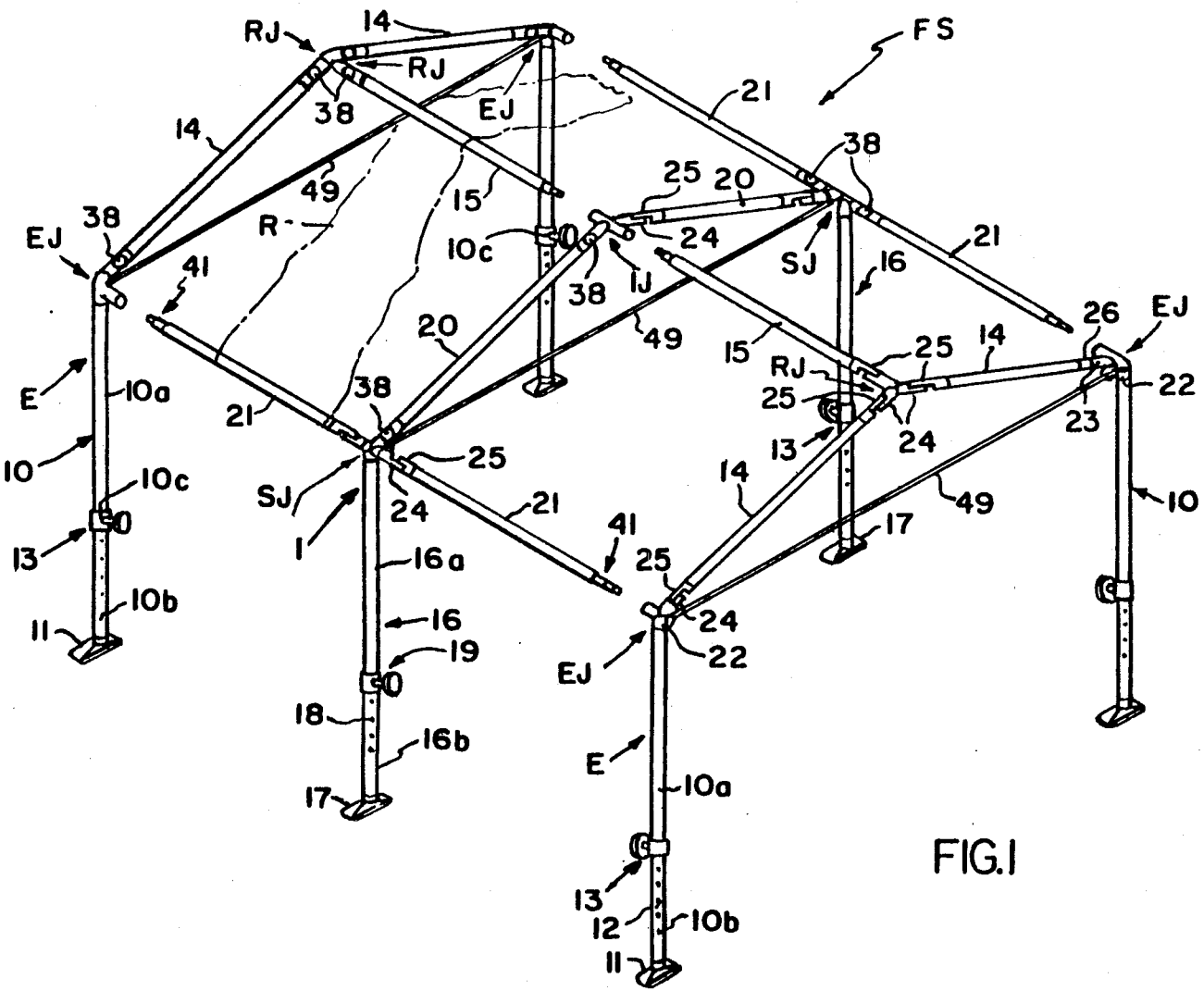
FIG. 1 is a schematic perspective, elevational view, with the three frames forming the system in separated position to indicate the manner of assembly.

Referring now more particularly to the accompanying drawings, and in the first instance to FIG. 1 thereof, the frame system, generally designated FS, is schematically disclosed in a position in which the two end frames or arches, generally designated E, and the intermediate frame or arch, generally designated I, are shown in erected position, with the frames E and I, however, in separated position to indicate the manner in which the frames E and I are inter-assembled. A canvas roof, generally designated R, may be releaseably secured in position to the ridge and side members which will be described, and overhanging canvas sides may also be provided in the usual manner.

Figure 2:
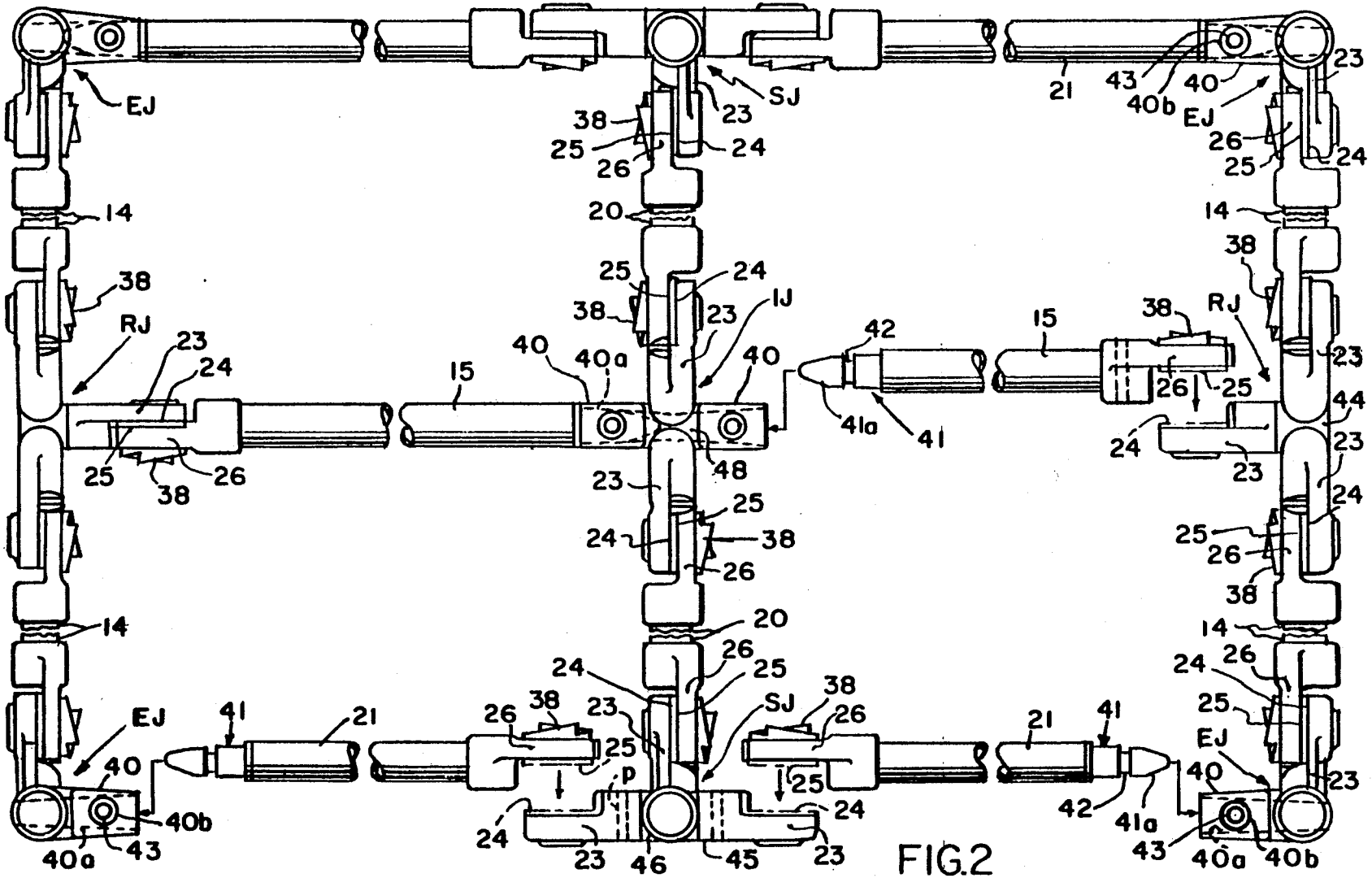
FIG. 2 is an enlarged, under plan view of certain of the roof-forming components, showing some of them in disengaged position and illustrating, more particularly, various joints which can be locked to rigidize the structure, locking handle actuators for the cam-actuated locking connections being omitted in the interests of clarity.
Figure 3:
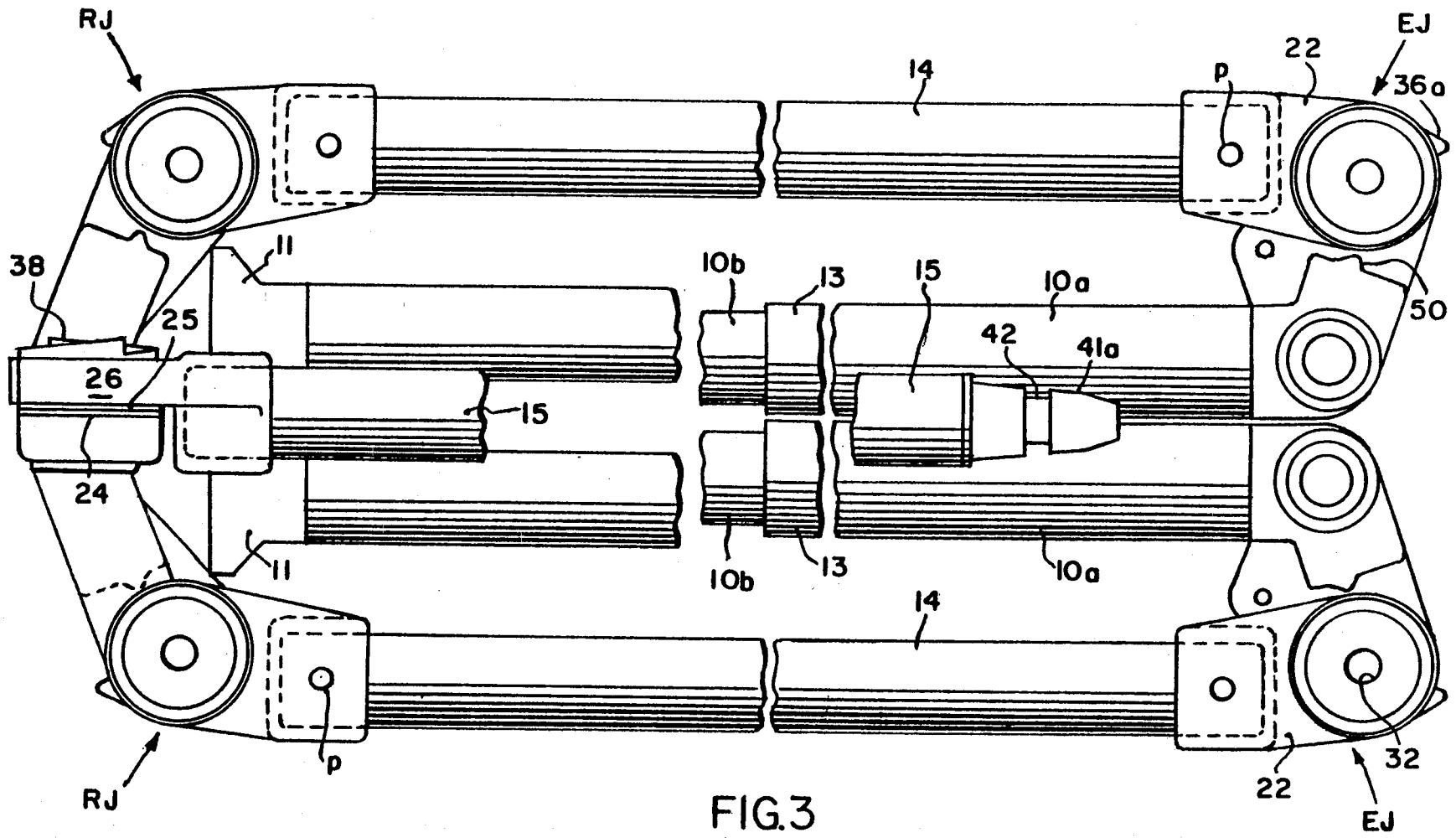
FIG. 3 is an enlarged, side elevational view of one of the end frames showing it in folded position.
Figure 5:
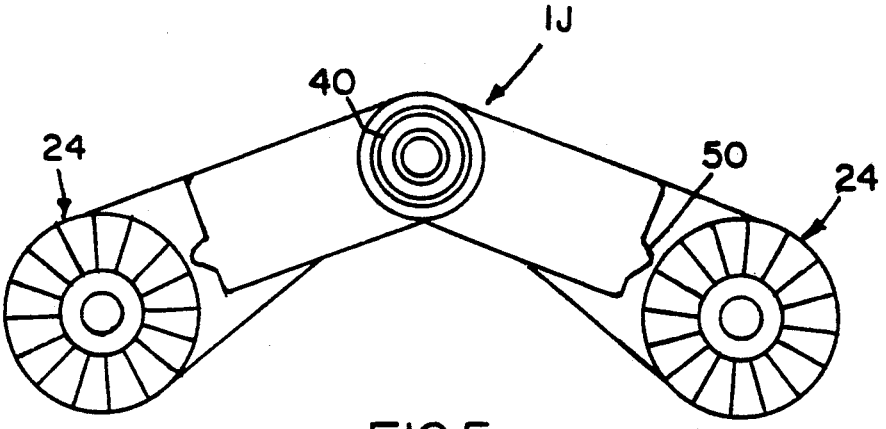
FIG. 5 is an enlarged side elevational view of the intermediate ridge frame joint.
Figure 4:
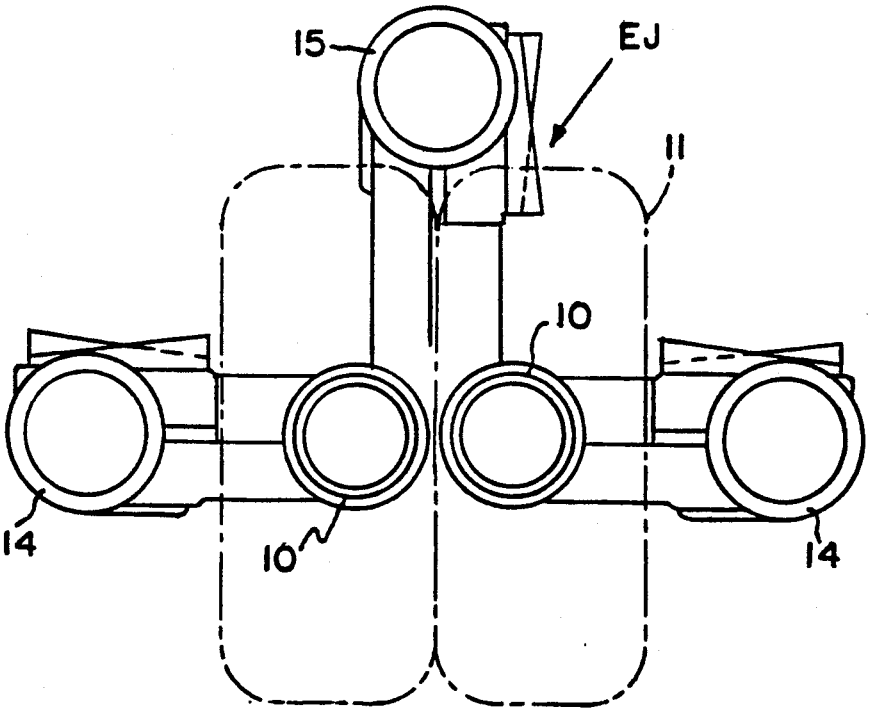
FIG. 4 is an end elevational view thereof.
Figure 6:
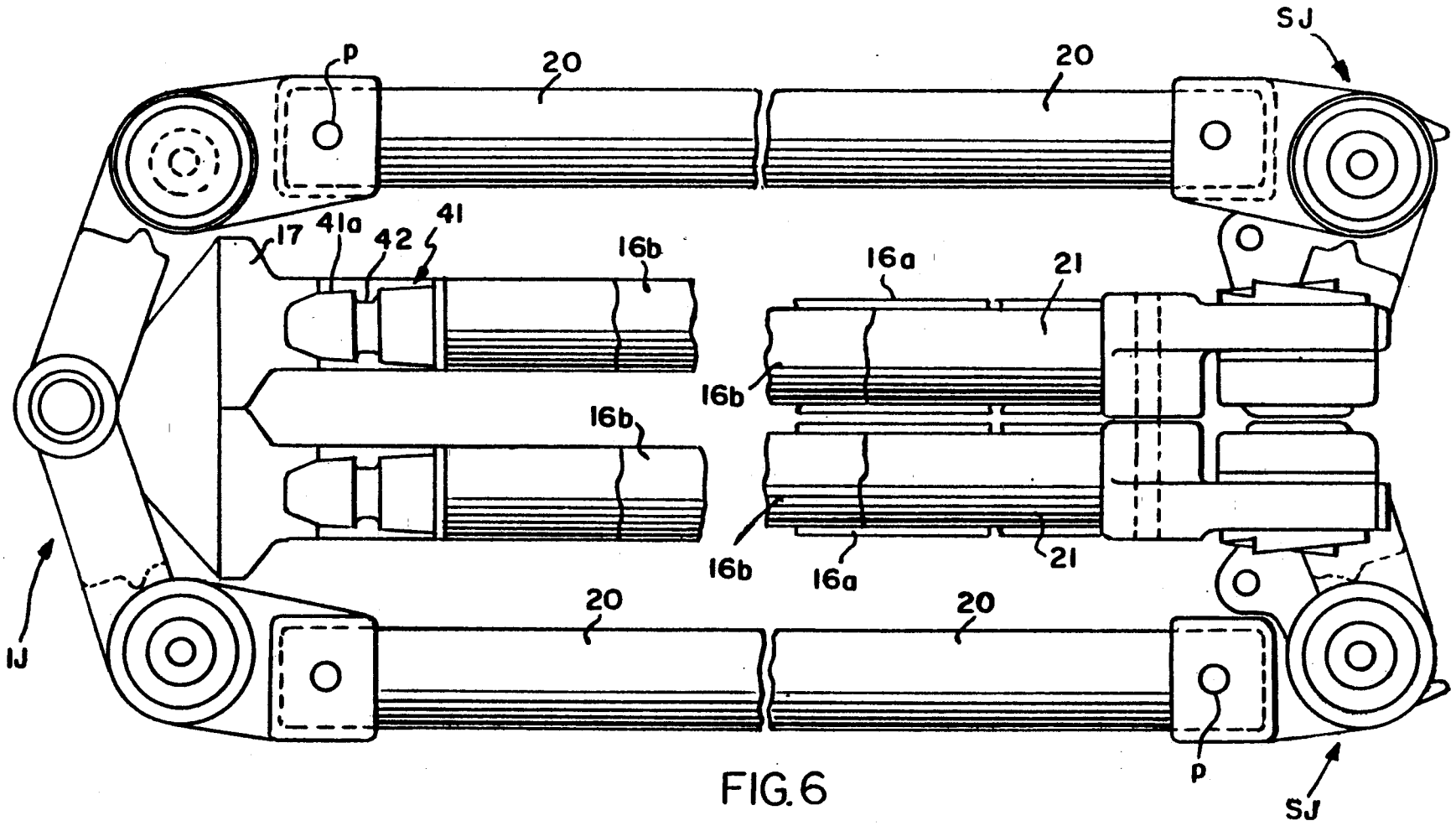
FIG. 6 is an enlarged, side elevational view of the intermediate frame showing it in folded position.
Figure 7:
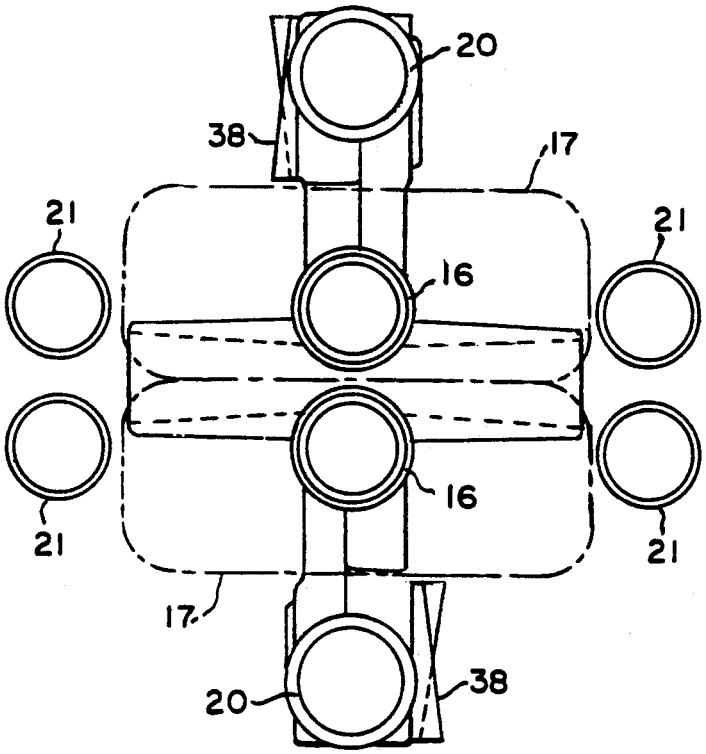
FIG. 7 is an end elevational view thereof.

It is to be emphasized that the separable end frames E are readily foldable to the compact condition in which they are shown in FIG. 3, for easy transport, and the intermediate frame I is likewise readily foldable to the position shown in FIG. 6, for the same purpose. FIG. 2 demonstrates the various cluster lock joints which are employed for selectively pivotally connecting the various elements, and which will be described in greater detail.

Each end frame E comprises a pair of transversely spaced corner posts, generally designated 10, made up of tubular upper members 10*a* which telescopically receive tubular lower members 10*b*, the latter having ground support feet 11 on their lower ends. Openings 12, provided in the portions 10*b* at vertically spaced intervals, receive set screws or spring retained pins 10*c* carried by a collar assembly 13, which is fixed on the lower end of each section 10*a* to provide means for adjusting the height of the post 10. The upper end of each corner post 10 carries an end cluster joint, generally designated EJ, which presently will be more particularly described. A rafter 14 extends from each end joint EJ to a ridge cluster joint RJ which pivotally mounts a ridge member 15 extending inwardly toward the intermediate frame I. Each of the end cluster joints EJ is identical and the various components thereof are accordingly identified by the same numbers.

Each intermediate frame I similarly has a pair of transversely spaced side ground support posts, generally designated 16, which includes an upper member 16*a* and a lower member 16*b* with a foot 17 thereon. Vertically spaced openings 18 provided in the lower member 16*b*, which is telescopically received within the tubular member 16*a* and holds member 16*a* in adjusted position via a pin assembly 19, similar to assembly 13 and cooperable with one of the openings 18. At its upper end, each intermediate frame support post 16 includes a side cluster joint SJ, from which an upwardly inclined rafter 20 extends toward an intermediate frame ridge cluster joint IJ. Also extending from each side cluster joint SJ are a pair of side support rods or eaves 21, which, in a manner to be described, connect to the end cluster joints EJ of the end frame members E.

Figure 13:
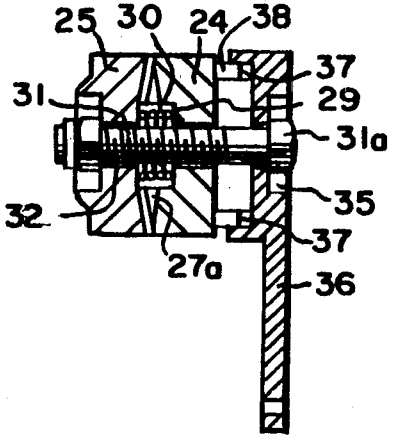
FIG. 13 is a similar view showing the parts in locked position.
Figure 14:
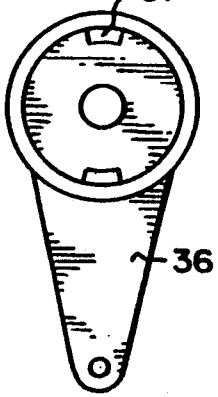
FIG. 14 is a face elevational view showing cam related structure which may be employed on the operating lever.
Figure 12:
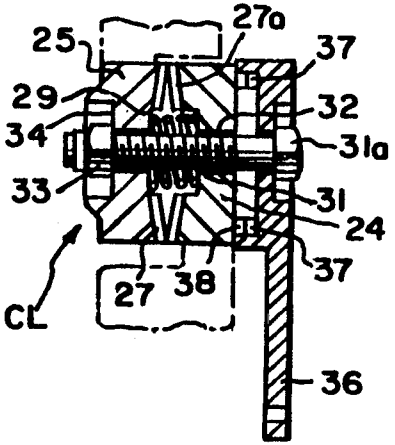
FIG. 12 is an enlarged transverse sectional view more particularly illustrating the cam-lock connection which is employed on many of the components, the parts being shown in the unlocked position.
Figure 15:
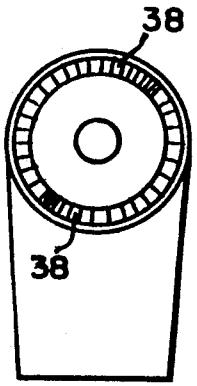
FIG. 15 is a similar view showing the cam ramp structure utilized on the interacting lock member.

Each end cluster joint EJ includes a body, generally designated 22, with a bottom opening socket for receiving the upper end of a leg or post section 10*a*, which is fixed to the body 22 by pinning, or in any other suitable manner. Also forming a part of the end cluster joint body 22 is a fixed arm or stub 23 having a locking head portion 24 which mates with the lockhead 25 of a similar arm or stub 26 which is affixed to one of the rafters 14. The axially mating lockheads 24 and 25 are constructed in the manner indicated in FIGS. 12–15 so that in unlocked position they are relatively pivotal to permit the relative folding of the rafters 14 and legs 10, as shown in FIG. 3, but, when in locked position, support the leg 10 and rafter 14 rigidly in the position shown in FIG. 1. The unlocked position of the parts, in which relative pivotal movement is permitted, while the parts are nevertheless prevented from longitudinally separating, is illustrated in FIG. 12, and the locked position of the parts, in which the parts 10 and 14 are held rigidly in a nonpivotal relationship, is illustrated in FIG. 13.

Figure 9:
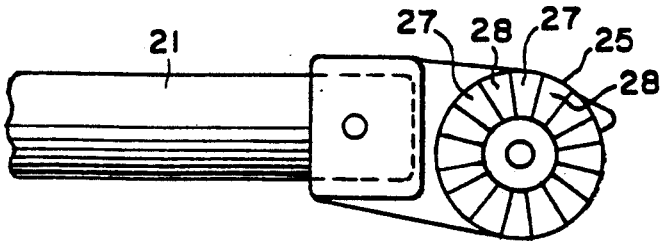
FIG. 9 is a side elevational view taken on the line 9—9 of FIG. 8.
Figure 10:
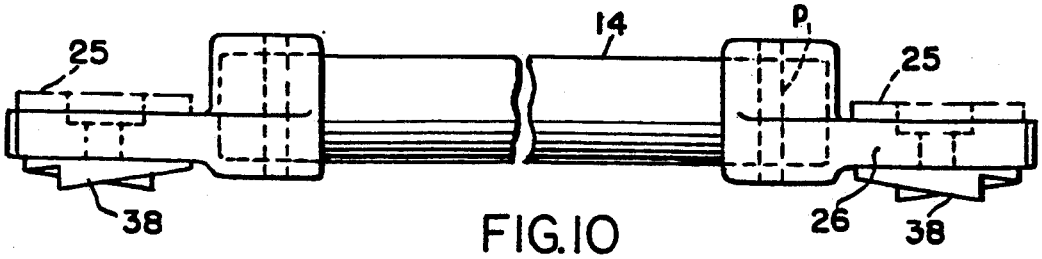
FIG. 10 is an enlarged top plan view of one of the rafter members.

It is to be understood that the cam-lock connections CL formed by the arms 23 and 26, and the lock heads 24 and 25, are utilized in a variety of locations in the shelter frame in frame elements E and I and, for purposes of convenience, will be given the same numbers. The arms 26 may be fixed to the rafters 14 and 20, the ridge members 15, and eave members 21 by pinning as at p. Similarly, the arms 23 may be fixed to the various cluster joints EJ, RJ, SJ and IJ, by pins p. In FIG. 9, one of the mating members 25 is shown as having a plurality of radially extending, axially projecting teeth 27 separated by complemental slots or openings 28. The heads 24 have similar teeth 27*a*, separated by complemental spaces 28*a*. The teeth 27*a* are of a size to axially fit within the spaces 28, and the teeth 27 are of a size to axially fit within the spaces 28*a*. Provided in each of the head portions 24 and 25, are central recessed portions 29 to accommodate a coil spring 30 surrounding a pivot pin or bolt 31 which extends through openings 32, provided in each of the heads 24 and 25, and which may be secured by a nut 33 seated in a well 34 provided in the locking head 25. The head 31*a* of the bolt 31 is received in a recess 35 provided in a manipulable revolvable locking lever or actuator 36 which has axial projections 37 (FIG. 14) interacting with a pair of cam ramp surface 38 provided on the actuator confronting face of head 24 (see FIGS. 15 and 16). The bolt 31 holds the heads 24 and 25 and the lever 36 in a relatively pivotal, unlocked position in FIG. 12. In FIG. 13, locking lever 36 has been rotated sufficiently to dispose the cams 37 and 38 in a relatively rotated position such that heads 24 and 25 are forced axially together to axially interengage the teeth 27 in the spaces 28*a*, and the teeth 27*a* in the spaces 28. In so doing, the return springs 30 are compressed.

The specific cam lock joint could be of the type illustrated in U.S. Pat. No. 3,889,908 for holding a pole in one of several positions, and need not be illustrated in more detail here. The heads 24 and 25 will remain securely cam-locked in the nonpivotal position shown in FIG. 13 by handle 36, until such time as it is desired to rotate handle 36 to restore the parts to the FIG. 12 position.

Figure 8:
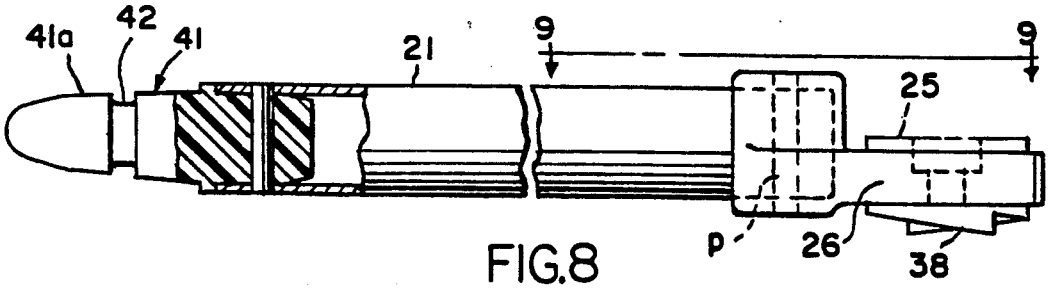
FIG. 8 is a considerably enlarged, side elevational view of one of the end frame ridge members.

Each end cluster joint EJ further includes the sidewisely projecting socket 40 extending from its body 22. The interior bore of socket 40 is tapered as at 40*a* to receive the complementally tapered male plug insert 41 fixed to the end of an eave member 21 which preferably is formed of a hard-wearing plastic material such as "Nylon" or "Kevlar". Insert member 41 has an intermediate groove 42 (see FIG. 8 particularly) for reception of a pin 43 which is spring urged into the groove 42 to releaseably retain the plug end 41 in captured position within the socket 40*a*. The male insert-socket connection 41–40 is used in other locations in the frame system and will be identified by the same numerals throughout (see more particularly FIG. 2 of the drawings).

Thus, end joints EJ essentially include a body fixed to the upper end of corner post 10, a transversely projecting arm or stub 23 with a cam-locking head 24 thereon, and a projecting stub 40 with a socket 40*a* provided therein, and, accordingly, may be appropriately termed multiple connection or cluster joints.

As indicated, each of the rafters 14 incorporates a lock arm 26 with a cam-lock head 25 thereon at its inner end incorporating a locking handle 36. At its opposite end each rafter 14 incorporates a lock arm portion 26 with a lock head 25 and a locking handle 36.

Figure 11:
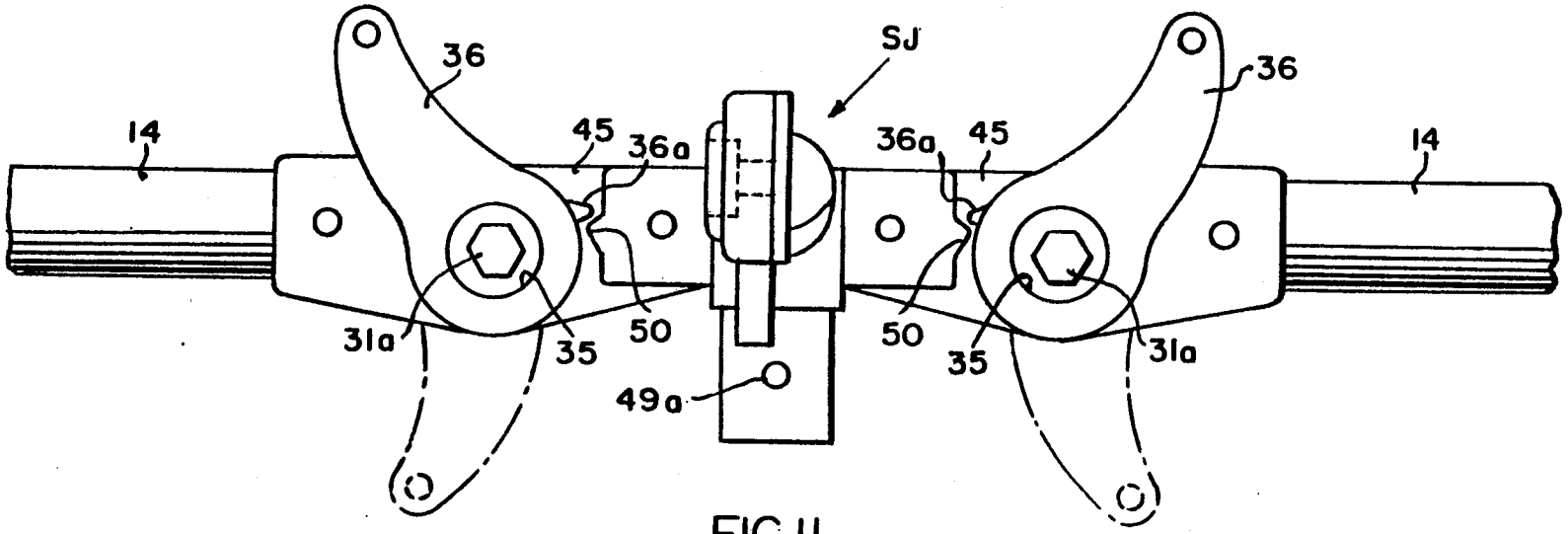
FIG. 11 is a side elevational view illustrating the ridge joint on one of the end frames.

The ridge cluster joint RJ of each end frame E (see also FIG. 11) includes a casting body generally designated 44 from which integrally extends a lock arm 23 having a locking head 24 which cooperates with the lock head 25 on the lock arm 26 extending from each rafter 14 to lock the inner ends of the rafters 14 to the ridge cluster joint RJ in the manner described previously with respect to FIGS. 12–15. The casting body 44 of each ridge cluster joint RJ, therefore, not only has an integrated lock arm 23 extending at the proper rafter angle to align co-extensively with the proper angle of extent of rafters 14 in FIG. 1, it also has an inwardly projecting lock arm 23 projecting at right angles to the plane in which rafters 14 lie to cooperate with a lock arm 26 fixed to the outer end of the incorporated ridge member 15, which has a cam-lock head 25 and lever 37 thereon to cooperate with the locking head 24 on the arm 23.

Each side cluster joint SJ (the intermediate frame IJ) has a body 45 with a sleeve 46 to accommodate and fix to the upper end of side post 16. At each side of the body casting 45, a lock arm or stub 23 with a cam-lock head 24 thereon projects integrally. The lock heads 24 cooperate with lock heads 25 on arms or stubs 26 fixed to the ends of the eave members 21. Finally, a lock arm or stub 23 also projects from each body 45 at an angle aligned with the angle of extent of rafter 20, the lock arm 23 having a cam-lock head 24 cooperating with the cam-lock head 25 provided on the lockarm 26 fixed on the outer end of each rafter 20.

Each intermediate cluster ridge joint IJ includes a pair of opposing lock arms 23, projecting from a body 48, each with a lock head 24 in cooperative captured engagement with the lock head 25 on an arm 26 extending rigidly from the inner end of a rafter 20. The body 48 of ridge joint IJ also includes a pair of integrated oppositely projecting socket sleeves 40 with sockets 40*a* tapered complementally to receive the tapered ends 41*a* of the insert members 41 which are provided on the inner end of each ridge member or purlin 15. The ends 41*a* on the ends of the ridge purlins 15 releaseably connect with the sockets 41 on the intermediate ridge joint IJ in the same manner as the male inserts 41*a* on the side or eave members 21 connect with the sockets 41 provided on the end joint bodies 22. When all of the male insert members 41 are disengaged from the sockets 40, and all of the lock levers 36, some of which are right hand and some of which are left hand, in terms of their direction of rotation to locked position, are swung to an unlocked position, the various elements of each end frame E may be folded to the position shown in FIG. 3, and the component parts of the intermediate frame I can be folded to the position in which they are shown in FIG. 6.

The erection of the end frames E and intermediate frame I is readily accomplished by unfolding the various components to the position in which they are shown in FIG. 1. Erection is facilitated by the fact that the various lock levers 36 can be sequentially swung to a locked position to provide components which then are locked in a proper position of angular extension. The lock levers 36 have stops 36*a* provided on them which mate with stops 50 provided on the body castings of the end joints EJ, ridge joints RJ, side joints SJ and the intermediate frame ridge joint IJ. These stops 36*a* and 50 are engaged when the handles 36 are swung to unlocked position and prevent the handles 36 from overtraveling. Thus, the handles 36 are prepositioned and are swung through a maximum of about 135 degrees to reach locked position.

The longitudinal cable 49 for each frame E and I is the only cable that is utilized when the frames are assembled, and each attaches, as shown, through openings 49*a* provided in dependent plate portions of the bodies of the joints EJ and SJ. To complete the assembly of the parts shown in FIG. 1, it is merely necessary to move the end frames E toward the intermediate frame I, and to engage the male plugs 41 in the sockets 40 after first pulling out the stop or detent pin handles 40*b* to pull the stop pins 43 out and permit the entrance of the male parts 41*a*. When the handles 40*b* are released, the stop pins 43 engage in grooves 42 to lock the frames E and I in interassembled position. Cables 49 can then be attached.

The various cluster joints used in the structure are preferably formed of a hardened elastomeric material such as polyurethane so that the relatively thinner arms 23 and 26 are more rugged than if formed of aluminum. The parts 23 are always provided on the joints EJ, RJ, SJ, and IJ so that it is the rafters 14 and 20, ridge members 15, and eaves 21 which are moved bodily or axially relative to the cluster joints when the lock levers 36 are manipulated to lock the parts to the respective cluster joints to prevent relative pivoting.

Although preferred embodiments of the invention have been illustrated in the accompanying drawings and described in the foregoing detailed description, it will be understood that the invention is not limited to the embodiments disclosed, but is capable of numerous rearrangements, modifications and substitutions of parts and elements, without departing from the spirit of the invention which is defined in the following claims.

What is claimed is:

1. A rapidly dismountable and erectable elongate shelter frame system having four corners for use with a canvas top and sides or the like comprising:

a. a pair of foldable end frame members, each of which is foldable into a compact assembly of connected parts including a pair of transversely spaced vertical legs forming ground support corner posts at two corners of the structure;

b. an end joint permanently attached to the upper end of each post and a pair of upwardly inclined end rafters pivotally connected to said end joint extending from each end joint toward one another;

c. an end ridge joint to which each of said rafters connects;

d. a ridge member projecting from each ridge joint perpendicularly to said rafters;

e. an intermediate frame member which is foldable into a compact assembly of connected parts and has a pair of transversely spaced vertical legs forming intermediate ground support posts in alignment with said posts of the end frames;

f. side joints permanently attached to the upper ends of said legs of the intermediate frame and a pair of upwardly inclined intermediate rafters extending from said side joints toward one another in parallelism with said rafters on the end frame;

g. an intermediate ridge joint to which each of said intermediate frame rafters connects and each of said ridge members also connects;

h. upper side members extending from each side joint and releasably connected to each end joint;

i. said end joints incorporating mechanisms to disengagably receive said upper side members and lock them in received position and to lock said end rafters in extended position while permitting said end rafters to fold down to a position in parallelism with said corner posts when unlocked;

j. said end ridge joints incorporating mechanism to lock said ridge members in extended position wile permitting them to fold down to a position in parallelism with said corner posts when unlocked; and k. said side joints incorporating mechanism to lock said intermediate rafters in extended position while permitting them to fold down to a position in parallelism with said intermediate ground support posts when unlocked.

2. The frame system of claim 1 wherein said end joints each comprise a sidewisely facing socket for receiving an end of one of said side members of the intermediate frame telescopically, and manipulatable locking means extending from each said socket radially inwardly to interengageably lock said side member end in the socket.

3. The frame system of claim 2 wherein said end joints further include a stub extending in a plane perpendicular to said sockets at an angle to coextend with said end rafters, each said stub and end rafter having a lock plate with a confronting face generally in the plane of extension of said end rafters, said faces being in relatively pivotal confronting relation and having radially interfitting axial projections thereon in one position of confrontation which are axially disengaged in another more spaced apart unlocked position of confrontation in which the rafters can pivot to fold to said positions of parallelism with said corner posts; means normally urging said lock plates apart to said unlocked position; and lever operated cam means operable to move said lock plates toward one another to dispose said axial projections in interfitted locked position and further operable to permit said means normally urging the lock plates apart, to return said lock plates to unlocked position.

4. The frame system of claim 3 in which said end ridge joint includes a pair of rafter stubs lying in a common plane with which said end rafters co-extend, each rafter stub and end rafter each having a lock plate with a confronting face generally in the plane of extension of said end rafters, said faces being in relatively pivotal confronting relation and having radially interfitting axial projections thereon in one position of confrontation which are axially disengaged in another more spaced apart unlocked position of confrontation in which the end rafters can fold to lie in side by side relation; means normally urging said lock plates apart to said unlocked position; and lever operated cam means operable to move said lock plates toward one another to dispose said axial projections in interfitted locked position and further operable to permit said means normally urging the lock plates apart, to return said lock plates to unlocked position.

5. The frame system of claim 4 in which said ridge joints for the end frames also have a ridge stub extending in a plane perpendicular to the plane in which said rafter stubs lie, each said ridge stub and ridge member having a lock plate with a confronting face generally in the plane of extension of said ridge member; means pivotally connecting said lock plates; said faces being in relatively pivotal confronting relation and having radially interfitting, axial projections thereon in one position of confrontation which are axially disengaged in another more axially spaced unlocked position of confrontation in which the ridge members can fold to lie in side to side relation with said folded rafters; and means operable to selectively move said lock plates toward one another to dispose said axial projections on the lock plates for said ridge member and ridge stub in axially interfitted locked position and to return them to a more axially spaced unlocked position in which the projections are axially disengaged.

6. The frame system of claim 3 in which pivot pin means connects said lock plates for relative pivotal movement, and said cam means is pivotally mounted on said pin means and is in engagement with the lock plate on said rafter.

7. A rapidly erectable and strikeable, foldable unitary shelter frame member for use with a canvas top or the like comprising:

a. a pair of transversely spaced vertical legs forming ground support posts;

b. a cluster end joint permanently attached to the upper end of each post having an upwardly inclined rafter stub and a side member stub extending at right angles thereto;

c. a pair of upwardly inclined end rafters in one position pivotally connected to the rafter stub on each end joint and extending at an upwardly inclined angle toward one another;

d. an end ridge cluster joint having divergent rafter stubs to which each of said rafters connects;

e. a ridge element projecting from said ridge joint perpendicularly to said rafter stubs;

f. pivot members extending axially transversely to the rafters pivotally connecting each of the rafter stubs to the rafters; each of the rafter stubs and rafters having a confronting face through which said pivot members extend;

g. radially interfitting axial projections on each of said confronting faces movable axially relatively with respect to said pivot members to and from a locked position in which the axial projections are axially intermeshed and prevent relative pivoting of the rafters and legs, and an unlocked position in which they are separated axially and permit relative pivotal folding movement of the rafters and legs; and h. manipulatable means for relatively moving said axial projections to and from locked and unlocked position; and i. wherein the legs and rafters are generally parallel to each other when the frame member is folded.

8. The member of claim 7 in which said manipulatable means is mounted for pivotal movement on said pivot member.

9. The member of claim 7 in which said side member stub on the cluster end joint incorporates a socket for receipt of an eave member.

10. The member of claim 7 in which said ridge member comprises a ridge stub on said ridge cluster joint and a ridge member pivotally connected thereto.

11. The member of claim 7 in which said cluster end joint side member comprises a first side stub and a side cluster joint is provided and includes a second side stub extending oppositely to said first side stub, and an eave member pivotally connected to each side stub.

12. The member of claim 7 in which said manipulatable means displaces said rafters relative to said joints when moving said axial projections to and from locked position.

13. A rapidly erectable and strikeable foldable unitary shelter frame member for use with a canvas top or the like comprising:

a. a pair of transversely spaced vertical legs forming ground support posts;

b. a cluster end joint permanently attached to the upper end of each post having an upwardly inclined rafter stub and an eave member extending at right angles thereto;

c. a pair of upwardly inclined rafters pivotally connected to the rafter stub on each end joint and, in one position, extending at an upwardly inclined angle toward one another;

d. a ridge cluster joint having divergent rafter stubs to which each of said rafters connects;

e. a ridge element projecting from said ridge joint perpendicularly to said rafter stubs;

f. pivot members extending axially transversely to the rafters pivotally connecting each of the rafter stubs to the rafters; and g. lock members movable relatively to said pivot members from a locked position in which they prevent relative pivoting of the rafters and legs to an unlocked position in which they permit relative pivotal folding movement of the rafters and legs; and h. wherein the legs and rafters are generally parallel to each other when the frame member is folded.

14. The member of claim 13 in which said eave member on the cluster end joint incorporates a socket for receipt of an eave element.

15. The member of claim 12 in which said ridge element comprises a ridge stub on said ridge cluster joint, and a ridge member is pivotally foldably connected thereto.

16. The member of claim 13 in which said cluster end joint eave member comprises a first side stub and said cluster end joint includes a second side stub extending oppositely to said first side stub, and an eave element pivotally foldably connects to each side stub.

17. A rapidly dismountable and eractable shelter frame system for supporting a cover including:

a first unitary foldable frame with two spaced legs forming ground supports, a joint permanently attached to the upper end of each leg, a first rafter pivotally connected to the joint on the upper end of one of the legs forming a ground support, a second rafter pivotally connected to the joint on the upper end of the other leg forming a ground support and a ridge joint pivotally connected to the first and second rafters;

a second unitary foldable frame with two spaced legs forming ground supports, a joint permanently attached to the upper end of each leg, a first rafter pivotally connected to the joint on the upper end of one of the legs forming a ground support, a second rafter pivotally connected to the joint on the upper end of the other leg forming a ground support and a ridge joint pivotally connected to the first and second rafters;

a ridge member pivotally connected to the ridge joint on one of the foldable frames and releasably connected to the ridge joint on the other foldable frame;

a first eave member pivotally connected to a joint on the upper end of one of the legs forming a ground support for one of the foldable frames and releasably connected to a joint on the upper end of one of the legs forming a ground support for the other foldable frame;

a second eave member pivotally connected to a joint on the upper end of one of the legs forming a ground support for one of the foldable frames and releasably connected to a joint on the upper end of one of the legs forming a ground support for the other foldable frame; and locking means operable to lock and unlock each pivotal connection and when unlocked to allow pivotal movement of the legs and rafters of the foldable frame between an erected position and a dismounted position in which the legs and rafters are generally parallel to each other.

18. The rapidly dismountable and erectable shelter frame system for supporting the cover of claim 17, including a tension cable connected to the joints on the upper ends of the legs forming the ground supports for the first foldable frame and a tension cable connected to the joints on the upper ends of the legs forming the ground supports for the second foldable frame.

* * * * *